United States Patent [19]

Burandt

[11] Patent Number: 4,631,000

[45] Date of Patent: Dec. 23, 1986

[54] VARIABLE DISPLACEMENT HYDRAULIC PRESSURE INTENSIFIER

[75] Inventor: Wesley A. Burandt, Rockford, Ill.

[73] Assignee: Sundstrand Corporation, Rockford, Ill.

[21] Appl. No.: 631,981

[22] Filed: Jul. 16, 1984

[51] Int. Cl.[4] ..... F04B 17/00; F04B 35/00

[52] U.S. Cl. ..... 417/225; 91/6.5; 417/237

[58] Field of Search ..... 417/225, 271, 222, 237; 91/506, 6.5; 60/445

[56] References Cited

U.S. PATENT DOCUMENTS

| | | | |
|---|---|---|---|
| 2,452,470 | 10/1948 | Johnson | 417/225 |
| 2,525,934 | 10/1950 | Nixon | 60/52 |
| 3,106,057 | 10/1963 | Manning et al. | 417/237 |
| 3,188,963 | 6/1965 | Tyler | 103/2 |
| 3,252,419 | 5/1966 | Tyler | 103/2 |
| 3,384,027 | 5/1968 | Jennings et al. | 417/237 |
| 3,391,538 | 7/1968 | Orloff et al. | 60/53 |
| 3,431,857 | 3/1969 | Jennings et al. | 417/237 |
| 3,627,451 | 12/1971 | Kouns | 417/271 |
| 3,727,521 | 4/1973 | Reynolds | 417/222 |
| 4,077,746 | 3/1978 | Reynolds | 417/225 |
| 4,152,896 | 5/1979 | Tohma | 60/445 |
| 4,381,702 | 5/1983 | Myers | 417/222 |

*Primary Examiner*—William L. Freeh

*Attorney, Agent, or Firm*—Wood,Dalton,Phillips, Mason & Rowe

[57] ABSTRACT

A hydraulic pressure intensifier for boosting normal system pressure in a hydraulic system to a higher level in order to increase the force provided by a pressure-operated actuator. The hydraulic pressure intensifier has a motor-pump unit with a rotatable cylinder block with cylinders defining piston chambers and each having a movable piston therein. A wobbler controls the stroke of the pistons and the motor-pump unit functions as both a pump and a motor by means of porting to said cylinders including a supply pressure port, an intensified pressure port and a return pressure port. The motor-pump unit has normal maximum and minimum speed limits and when operating at different flow rates the speed thereof varies accordingly. In order to maintain the speed of the motor-pump unit within normal limits, the wobbler is adjustable to vary the stroke of the pistons and thereby vary the speed of rotation of the cylinder block for the same rate of fluid flow. The wobbler can be infinitely variable between limit positions or only between limit positions and the adjustment can be made automatically in response to a speed-responsive flyweight governor-controlled valve structure.

22 Claims, 4 Drawing Figures

VARIABLE DISPLACEMENT HYDRAULIC PRESSURE INTENSIFIER

DESCRIPTION

1. Technical Field

This invention relates to a hydraulic pressure intensifier for use in a hydraulic system for boosting normal system pressure to a predetermined level in order to increase the force provided by an actuator supplied with fluid under pressure.

When the actuator is used in aircraft actuation systems, the increased force derived from the actuator as a result of increased system pressure minimizes the requirements for additional actuators or additional aircraft surfaces to be controlled to resultingly minimize aircraft weight and drag to conserve fuel and improve aircraft performance. A possible range of flow requirements for the actuator can cause the hydraulic pressure intensifier to operate at speeds beyond either the normal minimum or maximum operating speed. The hydraulic pressure intensifier embodying the invention is adjustable to operate within the normal maximum and minimum speed limitations, with system flow requirements which would otherwise cause the speed to go beyond one of said limits.

2. Background Art

Many aircraft have control surfaces, such as flaps, that are moved and positioned by an aircraft actuation system incorporating a linear hydraulic cylinder. Without supplying pressure intensification, a considerable amount of power is wasted, due to the inherently wide variance of load during the stroke of the linear hydraulic cylinder. This energy that is wasted is dissipated as heat in the hydraulic fluid, with the result that aircraft cooling requirements are increased. This problem is even more severe when the hydraulic system has to be sized for causing operation of plural actuators simultaneously under maximum load conditions.

The size of a hydraulic actuator is also a concern, particularly taking into account the mounting thereof in a thin airfoil aircraft wing or in association with complex landing gears and low drag profile fuselages. The size of the hydraulic actuator is determined by the load requirements on the hydraulic cylinder and the pressure available to the piston movable within the cylinder. The force available from the hydraulic cylinder is simply the pressure differential available from the hydraulic system times the area of the piston to be actuated. In order to increase the force available, either the area of the piston or the pressure must be increased. The general approach has been to increase the area of the piston, with a resulting increase in weight and space requirements for the actuator. This can result in external high drag bulges on aerodynamic surfaces and resultingly heavier systems as well as reduced accessibility and high maintenance costs. In some current aircraft configurations, the diameter of an actuator and, therefore, the diameter of a piston within the hydraulic cylinder and, therefore, the output force available is dictated by restrictions in the area within the space envelope in which the actuator is mounted. As a result, the actuator output requirements may exceed the maximum permissible diameter of the actuator with the result that there are several alternatives, none of which are ideal. These alternatives either include downgrading the force requirement of the actuator, adding an extra control surface and actuator to the vehicle, or the addition of additional actuators added in parallel if the space envelope is restricted in one direction only, such as a thin aircraft wing.

An alternative to increasing the area of the piston is the use of a pressure intensifier to increase normal system pressure whereby the force available from the hydraulic cylinder can be increased without the adverse results derived from increasing the area of the piston.

Pressure intensifiers are known in the art and are devices that will boost a normal system pressure to a higher, predetermined level. One conventional method of intensifying pressure requires two hydraulic units, with one unit being a relatively large displacement hydraulic motor and the other unit being a smaller displacement hydraulic pump. The power is transferred from a hydraulic circuit having the motor to another hydraulic circuit having the pump and without mixing the fluids in the two circuits.

Another form of pressure intensifier is a motor-pump unit that will operate in one hydraulic circuit and will boost normal system pressure to a higher level. This boost in pressure is accomplished at the expense of the flow rate in the circuit which is decreased by approximately the same ratio that the pressure is amplified. An example of this type of hydraulic pressure intensifier is shown in the Reynolds U.S. Pat. No. 4,077,746, owned by the assignee of this application.

The system shown in the Reynolds patent includes a pressure intensification mode, illustrated in FIG. 5 of the patent, wherein a motor-pump unit has a rotatable cylinder block with a series of cylinders, each carrying a reciprocal piston and with the cylinder block rotating to carry the cylinders successively past a port plate having a supply pressure port, an intensified pressure port, and a return pressure port. In the intensification mode, the flow of fluid from the supply pressure port to the return pressure port causes rotation of the cylinder block and a portion of the fluid flow exits through the intensified pressure port at an increased pressure because of a pumping action of the motor-pump unit. The speed of the cylinder block in the Reynolds patent is a function of the displacement of the unit and the rate of fluid flow between the supply pressure port and the return/intensify pressure port. The displacement is set by cam means associated with the pistons and which is in a fixed position.

The motor-pump unit of the Reynolds patent has normal maximum and minimum speed limits. When a maximum rated speed is exceeded, components of the motor-pump unit will not operate properly including tipping of slippers which interconnect the pistons to the cam means in the form of a wobbler. Below the minimum speed, there will be a tendency for a stalling of the motor-pump unit with speed-up and slow-down thereof with resulting jerky operation.

The hydraulic pressure intensifier is used to intensify pressures at various flow rates to the actuator or actuators. In a hydraulic pressure intensifier of the type shown in the Reynolds patent, a reasonable range of flow would be ten to one or, for example, a flow range of ten gallons to one gallon per minute without exceeding the upper and lower speed limits for the motor-pump unit.

The invention to be described hereinafter distinguishes over the prior art in providing a hydraulic pressure intensifier having a motor-pump unit of the Reynolds type and wherein the stroke of the pistons mounted within the cylinders in the cylinder block can be varied to vary the displacement of the motor-pump unit. The supply pressure is intensified while varying the speed of rotation of the cylinder block to increase the range of fluid flow within which the hydraulic pressure intensifier can operate without going beyond the desired maximum and minimum speeds of operation of the motor-pump unit. The use of a motor-pump unit having variable displacement can increase the flow range of ten to one in the fixed displacement unit of the type shown in the Reynolds patent to a greater flow range, for example, approximately twenty to one.

BEST MODES FOR CARRYING OUT THE INVENTION

Figure 1:
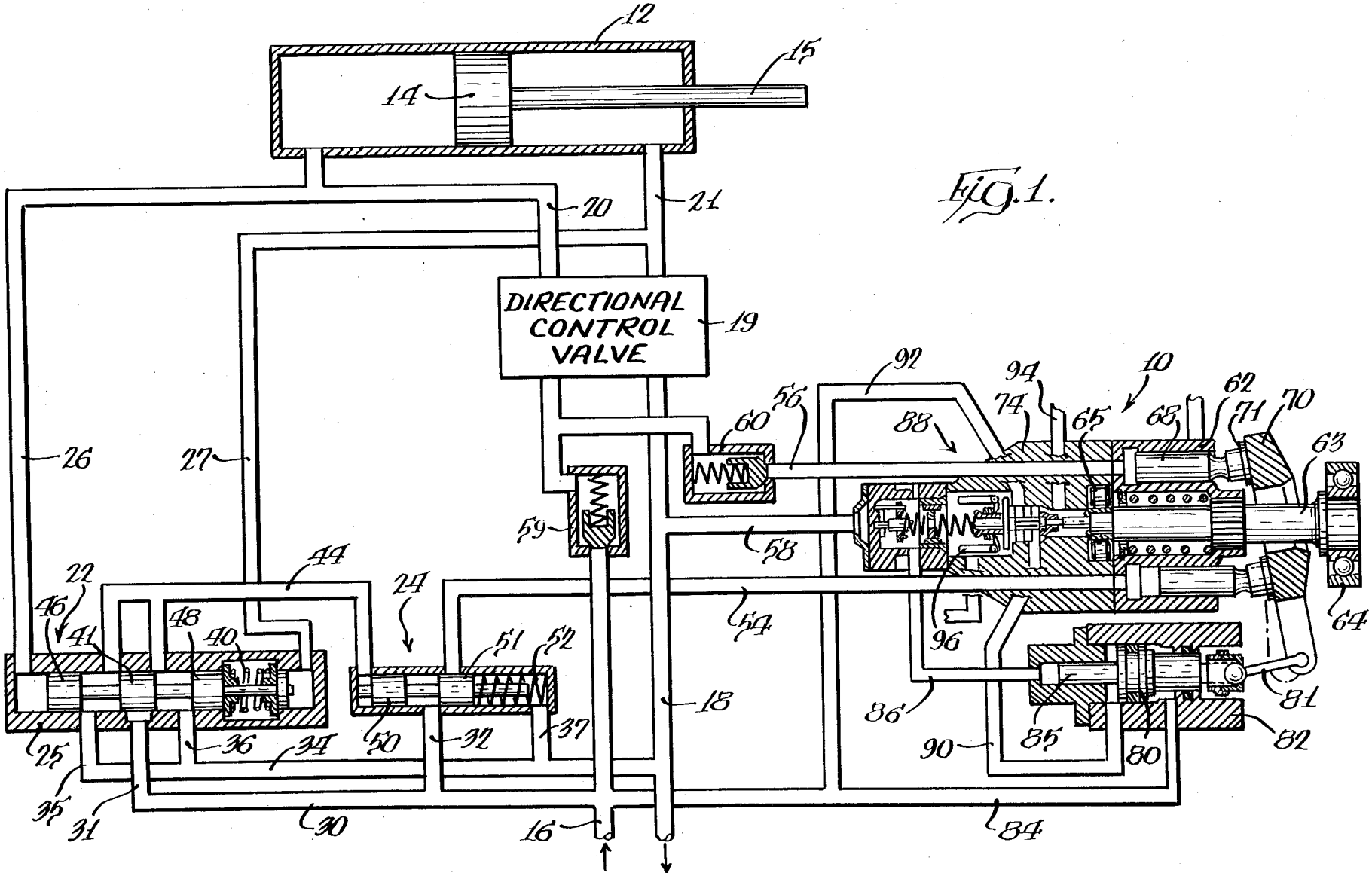
FIG. 1 is a schematic illustration of one embodiment of the hydraulic pressure intensifier shown in central section and in association with a hydraulic circuit.

A first embodiment of the invention is shown in FIG. 1 wherein a hydraulic pressure intensifier, indicated generally at 10, is shown in a hydraulic circuit. The hydraulic circuit has an actuator, in the form of a hydraulic cylinder 12 having a piston 14 and a piston rod 15 connectable to a component to be moved, such as a control surface of an aircraft.

A supply pressure line 16 and a return line 18 connect to a directional control valve 19. A pair of lines 20 and 21 connect the directional control valve to opposite ends of the hydraulic cylinder. With the supply pressure line 16 connected to a source of fluid pressure and with fluid flow through the line 16 available at a uniform selected rate, the directional control valve 19 can be positioned to block flow to the hydraulic cylinder 12 or cause the pressure flow to one side or the other of the piston 14 for the desired direction of movement of the piston rod 15.

The hydraulic pressure intensifier 10 is operable to increase the pressure of the fluid supplied to the hydraulic cylinder 12 as an impending stall condition exists at the hydraulic cylinder. This condition is sensed by a pilot valve, indicated generally at 22, which senses a pressure difference at opposite sides of the piston 14 and, when the pressure difference is above a predetermined level, the pilot valve shifts to shift a main stage valve, indicated generally at 24, and place the hydraulic pressure intensifier in operation in the hydraulic circuit. The pilot valve has a valve body 25 with a bore having opposite ends connected to opposite ends of the hydraulic cylinder 12 by lines 26 and 27, respectively. Each of the pilot valve 22 and the main stage valve 24 has a supply pressure port connected to the supply pressure line 16 by a line 30 and branch lines 31 and 32, respectively. Each of the valves has connections to the return line 18 by a line 34 and branch lines 35, 36, and 37.

The pilot valve 22 has a valve spool which is normally in a centered position by spring-centering means 40 whereby a valve land 41 blocks communication of the supply pressure port with either of a pair of ports connected to a pilot line 44 extending to an end of the main stage valve 24. In the centered position, the pilot line 44 is in communication with the branch return lines 35 and 36. When a differential pressure exists across the ends of the valve spool of the pilot valve adequate to overcome the force of the spring-centering means 40 (as the hydraulic cylinder approaches an impending stall condition), there is a corresponding shift of the spool in one direction or the other to move the valve land 41 to a position wherein supply pressure is directed to the pilot line 44 to cause a shift of the main stage valve. One of the valve lands 46 or 48 of the valve spool of the pilot valve blocks communication of the branch return line 35 or 36 that is not blocked by the valve land 41.

The main stage valve 24 has a valve spool with lands 50 and 51, with land 50 being a pilot land responsive to the pressure in the pilot line 44 to urge the valve spool against the force of a spring 52. When the pilot valve 22 operates to deliver pressure in the pilot line 44 to the main stage valve 24, the valve spool is caused to shift against the action of the spring 52 whereby the branch supply pressure line 32 connects to a connecting supply pressure line 54 leading to the hydraulic pressure intensifier 10.

The hydraulic pressure intensifier operates to receive a flow of fluid at supply pressure and increase the pressure thereof for delivery to the hydraulic cylinder 12, with a reduction in rate of fluid flow. Part of the fluid flow from the hydraulic pressure intensifier flows to the hydraulic cylinder 12 through a line 56 connecting to supply pressure line 16, with the remainder of the fluid flowing to the return line 18 through a line 58.

The hydraulic circuit has a pair of check valves 59 and 60. The check valve 60 is interposed in the line 56 which extends to the supply pressure line 16 downstream of the check valve 59. Flow of fluid at an increased pressure from the hydraulic pressure intensifier will flow to the supply pressure line 16 and the check valve 59 prevents reverse flow in the supply pressure line 16. The check valve 60 functions to prevent flow in the direction toward the hydraulic pressure intensifier whereby, when the latter is not in operation, supply pressure directed to the hydraulic cylinder 12 cannot flow to the hydraulic pressure intensifier.

The hydraulic pressure intensifier 10 is in the form of a motor-pump unit having a rotatable cylinder block 62 splined to a rotatable mounting shaft 63 supported by bearing means 64 and 65. The motor-pump unit is of the axial piston type wherein the rotatable cylinder block 62 has a series of cylinders, each of which reciprocally mounts a piston 68 and with the pistons 68 being associated with a wobbler 70 for setting the stroke of the pistons within piston chambers defined by the cylinders and, therefore, the displacement of the unit. The pistons 68 are slidably connected to the wobbler 70 by well known structure including a slipper 71 in sliding engagement with the wobbler 70.

Figure 3:
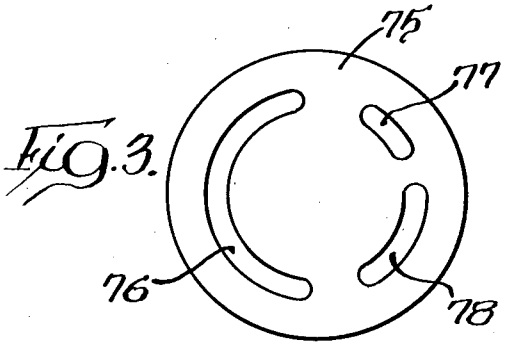
FIG. 3 is an elevational view of a port plate as used in both embodiments of the invention.

The motor-pump unit has a port plate 75 formed in a member 74 associated with the rotatable cylinder block 62 and with the construction of the port plate being shown in FIG. 3. The port plate 75 has a supply pressure port 76, an intensified pressure port 77 and a return pressure port 78. These ports are kidney-shaped and are circularly spaced from each other whereby in one revolution of the cylinder block 62 all of the cylinders thereof communicate with the three ports successively. The supply pressure port 76 is connected to the connecting supply pressure line 54 extending from the main stage valve 24 to receive supply pressure. The return pressure port 78 communicates with the line 58 connecting to the return line 18 and the intensified pressure port 77 communicates with the line 56 extending to the supply pressure line 16 downstream of the check valve 59.

Figure 4:
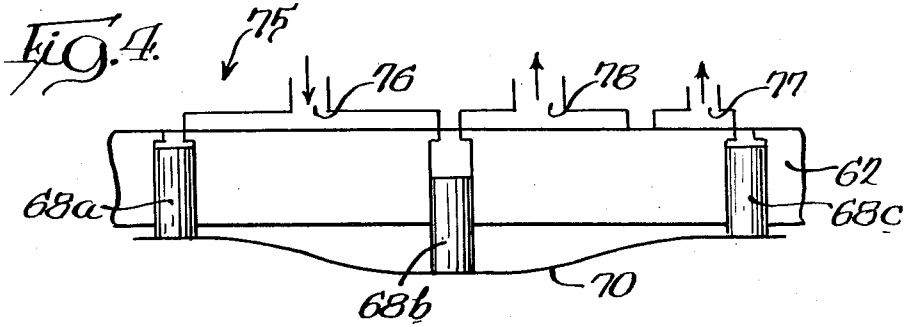
FIG. 4 is a diagrammatic roll-out view illustrating the action of the motor-pump unit.

The motor-pump unit receives fluid flow from the supply pressure line 16 and uses a portion of the fluid flow to cause a motoring action and rotation of the cylinder block 62. The balance of the fluid flow is utilized in operation of the hydraulic cylinder and is at an increased pressure because of a pumping action by the same structure which provides the motoring action. This action is illustrated in FIG. 4 wherein three pistons 68*a*, 68*b* and 68*c* are shown in association with the wobbler 70 and with the ports 76–78 of the port plate 75. With rotation of the cylinder block being represented by movement toward the right in the Figure, the piston 68*a* is caused to move outwardly of its cylinder by supply pressure entering at supply pressure port 76 to the extended position shown for the intermediate piston 68*b*. As the wobbler 70 causes the piston 68*b* to move toward the port plate, a portion of the fluid flows through the return pressure port 78 with resulting motoring action of the motor-pump unit. As a piston 68 progresses to the position of piston 68*c* shown at the right in FIG. 4, the piston chamber communicates with the intensified pressure port 77 and, by pumping action, the pressure of the fluid is increased.

The hydraulic pressure intensifier is an inline piston hydraulic unit which has three kidney-shaped ports successively communicating with the cylinders of the cylinder block. The pressure level or pressure ratio that the motor-pump unit will deliver is dictated by the length of the total sweep angle of the kidney ports. The relationship of the supply pressure to the build-up in the pressure at the intensified pressure port is approximately an inverse ratio of the length of the intensified pressure port 77 to the length of the supply pressure port 76. Another way of expressing this action is by an equation wherein the intensified pressure times the length of the intensified pressure port equals the supply pressure times the length of the supply pressure port times the torque efficiency of the hydraulic pressure intensifier.

With a controlled flow rate in the supply pressure line 16, there is a resulting speed of rotation of the cylinder block 62 derived from the motoring action thereof. In various situations, there are varying rates of fluid flow to the supply pressure line 16 and each different rate of flow results in a different rate of rotation of the cylinder block 62. The motor-pump unit has speed limitations below a minimum speed of rotation of the cylinder block 62 and also above a maximum speed of rotation. If the speed is too low, there can be cogging, which is a speed-up and slow-down action which results in a jerky action and, therefore, pulsing pressure at the intensified pressure port. When the speed is too high, the centrifugal forces can adversely affect the operation as by tipping of the slippers 71 which are in sliding engagement with the wobbler 70.

The invention relates to means by which the desired pressure intensification can occur at many differing flow rates to the hydraulic cylinder 12 while still operating the motor-pump unit at a speed within the design limits of the unit. The embodiment of FIG. 1 provides for automatic utilization of the hydraulic pressure intensifier and with an infinitely variable control to maintain the speed of the motor-pump unit within design limits. This control is achieved by having the wobbler 70 adjustable to vary the stroke of the pistons 68 and, therefore, have the motor-pump unit be a variable displacement unit.

With the wobbler 70 positioned as shown in full line in FIG. 1, the motor-pump unit is in a maximum displacement condition wherein the pistons 68 have a maximum stroke in a revolution of the cylinder block and, therefore, a certain rate of fluid flow to the hydraulic pressure intensifier will result in a certain speed of rotation of the cylinder block 62. If the wobbler 70 is moved to or toward the broken line position indicated in FIG. 1, displacement of the motor-pump unit is reduced whereby, for the same rate of fluid flow, the speed of the cylinder block 62 will increase. If the flow rate of fluid supplied to the hydraulic cylinder 12 reaches a level whereby the motor-pump unit will tend to cog with the wobbler 70 positioned in full line in FIG. 1, the wobbler 70 can be moved toward the broken line position to reduce the displacement of the motor-pump unit with a resulting increase in speed of rotation of the cylinder block 62 and without any change in the intensification of pressure delivered from the hydraulic pressure intensifier. Correspondingly, if the wobbler 70 is at the broken line position shown in FIG. 1 and the flow rate to hydraulic cylinder 12 is at a relatively high level which may cause the speed of the cylinder block 62 to be beyond the desired maximum speed, the wobbler could be moved toward the full line position to increase the displacement of the motor-pump unit and, thus, decrease the speed of rotation of the cylinder block 62.

An infinitely-variable control of the displacement is provided by the structure of FIG. 1 which utilizes a flyweight governor responsive to rotation of the cylinder block 62. The flyweight governor controls the pressure applied to a wobbler control piston 80 connected to the wobbler 70 by an interconnecting link 81 having swivel connections at each of its ends. The wobbler control piston 80 is mounted in a cylinder 82 and has one side thereof constantly exposed to supply pressure by a line 84 connecting to the supply pressure line 16. The control piston 80 has a differential area provided by means of a small piston 85 extending from one side of the wobbler control piston 80 and movable in a chamber which communicates with a line 86 extending to the line 58 which communicates with the return line 18.

A flyweight governor-controlled valve structure, indicated generally at 88, controls the application of supply pressure against the left-hand side of the wobbler control piston 80, as viewed in FIG. 1. This valve structure controls the connection of a control line 90 extending from the wobbler control piston cylinder 82 to either a supply pressure line 92 extending from the supply pressure branch line 84 or to a return line 94. The flyweight governor-controlled valve structure is generally of the type shown in the Benson U.S. Pat. No. 4,164,235, owned by the assignee of this application, and the disclosure thereof is incorporated herein by reference. This structure has speed-responsive flyweights 96 which set the position of a three land valve controlling communication of the supply pressure line 92 and the return line 94 with the control line 90. Flyweights 96 are pivotally mounted on a structure connected to the mounting shaft 63 and, at a normal set speed, the flyweight governor has the valve open for free connection of supply pressure from supply pressure line 92 to the control line 90. When the speed of the cylinder block 62 reduces, the flyweights 96 will move toward a collapsed position to shift the valve to partially block supply pressure and partially open the control line 90 to the return line 94 whereby supply pressure in line 84 operating on the right-hand side of the wobbler control piston 80 moves the wobbler 70 toward the broken line position to set reduced displacement for the motor-pump unit. The valve of the flyweight governor controlled valve structure is a three land valve comparable to the spool 42 of the Benson patent and with the porting thereto being comparable to utilization of ports 80, 86 and 88 in the Benson patent, with the port 80 being connected to supply pressure line 92, the port 86 being connected to the control line 90, and the port 88 being connected to the return line 94. The flyweight governor of this application operates differently from that in the Benson patent in that the governor of this application causes shift of the valve as the cylinder block 62 moves toward minimum speed, while the governor in the Benson patent is set to operate at a maximum speed condition. It should be noted that it is within the scope of the invention to have the wobbler 70 initially set to establish a minimum displacement condition and, when the speed of the cylinder block 62 exceeds a desired speed, the flyweight governor controlled valve structure could operate to shift the wobbler 70 toward the full line position and increase the displacement of the motor-pump unit and therefore decrease the speed of rotation of the cylinder block 62.

Figure 2:
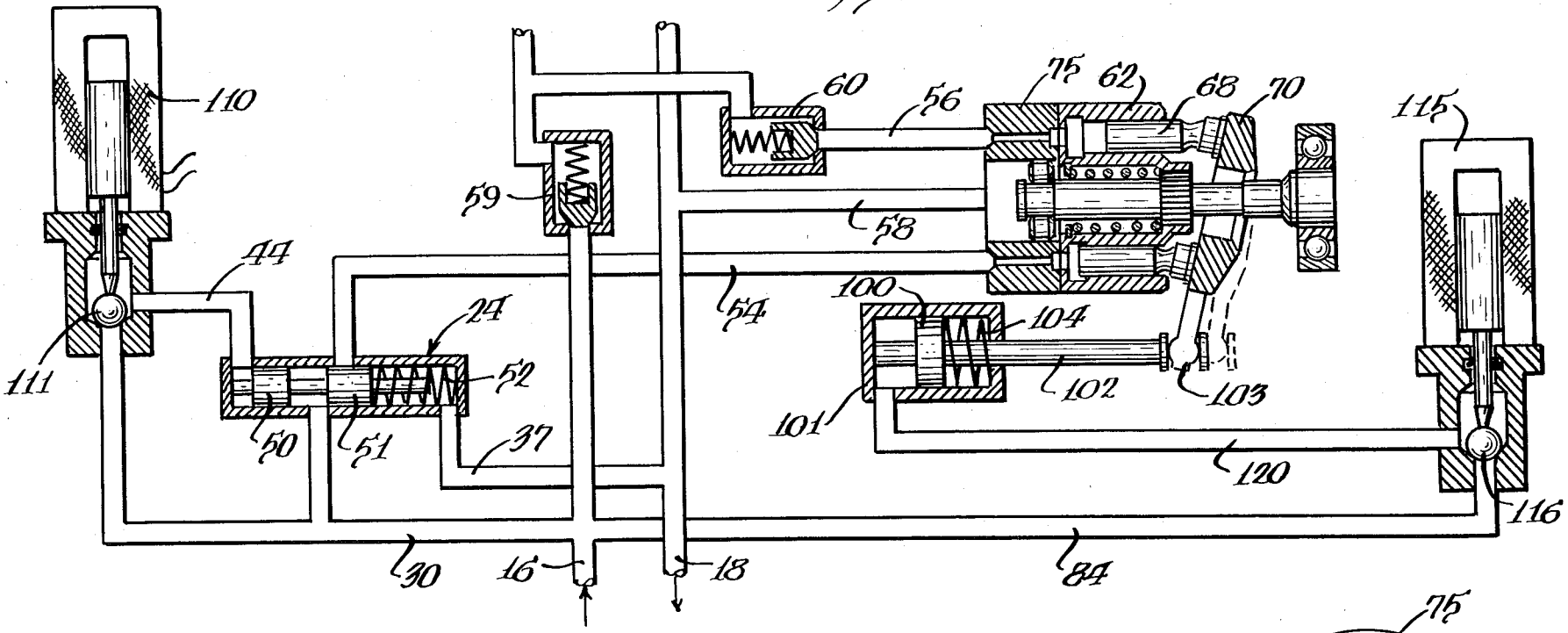
FIG. 2 is a schematic illustration of an alternate embodiment of the hydraulic pressure intensifier shown in association with a hydraulic circuit.

A second embodiment of the invention is shown in FIG. 2 which differs in the primary respect that the motor-pump unit of the hydraulic pressure intensifier may be set to two different displacements, rather than having infinitely variable displacement. The embodiment of FIG. 2 also differs in the form of control. An impending stall of the hydraulic cylinder 12 may be sensed by means (not shown) and when the stall is sensed a solenoid valve is operated to bring the hydraulic pressure intensifier into operation in the circuit. In the embodiment of FIG. 2, the same structure as used in the embodiment of FIG. 1 is given the same reference numeral.

In the embodiment of FIG. 2, the wobbler 70 is shown in full line in a maximum displacement-setting position and is shown in broken line in a minimum displacement setting position. The position of the wobbler is controlled by a wobbler control piston 100 movable within a cylinder 101 and having a rod 102 connected to the wobbler through a ball connection 103. A spring 104 within the cylinder urges the piston toward the left, as viewed in the Figure, to place the wobbler 70 in the full line position. In this position, the pistons 68 operate at maximum displacement and during rotation of the cylinder block 62 the piston chambers coact with the ports in the port plate 75 as described in connection with the embodiment of FIG. 1. When an impending stall condition is sensed, a solenoid valve 110 is operated to enable a ball valve 111 to open whereby supply pressure in branch supply pressure line 30 can communicate with the control line 44 leading to the main stage valve 24 with resulting shift thereof to direct supply pressure through the supply pressure connecting line 54 to the hydraulic pressure intensifier. When the speed of the cylinder block 62 of the motor-pump unit reduces to a minimum, the speed is sensed by suitable means (not shown) and a solenoid 115 is operated to enable a ball valve 116 to move from a blocking position and connect the branch supply pressure line 84 with a line 120 leading to the left-hand end of the cylinder 101. This causes the piston 100 to shift to the right as viewed in FIG. 2 to cause a reduction in the displacement setting of the motor-pump unit with resulting increase in speed of rotation of the cylinder block and without any change in the level to which the pressure is intensified.

As described in connection with the embodiment of FIG. 1, the initial set-up of the displacement of the motor-pump unit in FIG. 2 could be reversed whereby the wobbler 70 is normally set to establish a relatively small displacement for the motor-pump unit. When the speed of rotation of cylinder block 62 increases beyond the desired upper limit, the wobbler 70 can be moved to the position shown in solid line in FIG. 2 to increase the displacement of the pump and, therefore, reduce the speed of rotation of the cylinder block 62. A motor-pump unit having a fixed displacement could have an operation flow range of, for example, ten to one, while the same structure having a variably positionable wobbler 70 and, therefore, variable displacement may operate in a much larger flow range. A variable displacement hydraulic pressure intensifier can provide a set pressure amplification at any selected flow rate to the hydraulic circuit and the change in the displacement has no effect on the pressure amplification, but merely modifies the flow relation through the motor-pump unit.

I claim:

1. A hydraulic pressure intensifier comprising, a motor-pump unit having a rotatable cylinder block with cylinders each of which has a movable piston therein and a wobbler for controlling the stroke of the pistons and which functions simultaneously as both a pump and a motor by means of porting to said cylinders including a supply pressure port, an intensified pressure port and a return pressure port, means for supplying fluid under pressure to the supply pressure port at all times during operation with an increase in fluid pressure at the intensified pressure port, the improvement characterized by means for varying the position of the wobbler to vary the stroke of the pistons and thereby vary the speed of rotation of the cylinder block for a given rate of fluid flow to the unit with the speed of the cylinder block being solely dependent upon the stroke of the pistons, and means operable when the rotatable cylinder block of the motor-pump unit is operating at a speed limit for activating said wobbler position varying means to prevent the speed of the cylinder block from going beyond the speed limit while the pressure is maintained at the intensified pressure port.

2. A hydraulic pressure intensifier having a variable displacement axial piston motor-pump unit utilizing three rotationally sequenced ports comprising, a supply pressure port, a return pressure port and an intensified pressure port which, with a certain rate of fluid flow to the supply pressure port, provide for a reduced fluid flow at a higher pressure from the intensified pressure port with the remainder of the flow through the return pressure port, and means for varying the displacement of the motor-pump unit whereby said certain rate of fluid flow to the supply pressure port will result in a change in speed of the motor-pump unit to maintain the speed of the motor-pump unit within a desired range of speeds and without effect on the higher pressure at the intensified pressure port.

3. A hydraulic pressure intensifier as defined in claim 2 wherein said displacement varying means comprises a wobbler for setting the stroke of the pistons of the axial piston motor-pump unit, and means for adjusting the position of the wobbler.

4. A hydraulic pressure intensifier as defined in claim 3 wherein said means for adjusting the position of the wobbler comprises a selectively pressurized piston.

5. A hydraulic pressure intensifier for use in a hydraulic circuit having supply pressure and return fluid lines with a valve for controlling flow to a user device comprising, a motor-pump unit having a supply pressure port and a return pressure port with the latter port connected to said return fluid line, a branch supply pressure line extending to said supply pressure port of the motor-pump unit, said motor-pump unit also having an intensified pressure port, an intensified pressure line connecting said intensified pressure port with said supply pressure line, a main stage valve in said branch supply pressure line operable to control fluid flow to said motor-pump unit, means for operating said main stage valve for fluid flow to said motor-pump unit, and said motor-pump unit having a rotatable cylinder block with a series of cylinders each having a piston movable in succession past said supply pressure port, said return pressure port and an adjustable wobbler for controlling the stroke of the pistons and therefore the fluid displacement of the cylinders, and means for adjusting the wobbler to vary said displacement and therefore the speed of rotation of the motor-pump unit for the same rate of fluid flow through the motor-pump unit.

6. A hydraulic pressure intensifier as defined in claim 5 wherein said means for adjusting said wobbler includes means responsive to the speed of rotation of said cylinder block.

7. A hydraulic pressure intensifier as defined in claim 6 wherein said means for adjusting the wobbler includes a differential area control piston operatively connected to said wobbler, and said speed-responsive means includes a speed-responsive governor-controlled valve for controlling a pressure applied to one area of the differential area control piston.

8. A hydraulic pressure intensifier as defined in claim 5 wherein said means for operating said main stage valve includes a pilot valve for sensing a differential pressure at the user device.

9. A hydraulic pressure intensifier as defined in claim 5 wherein said means for operating said main stage valve includes an additional branch supply pressure line extended to the main stage valve, and a selectively operable valve normally blocking the delivery of supply pressure to said main stage valve.

10. A hydraulic pressure intensifier as defined in claim 5 wherein said means for adjusting said wobbler includes a wobbler control piston operatively connected to said wobbler, means urging said wobbler control piston to one limit position to set the wobbler at one displacement position, and selectively operable means for moving the wobbler control piston to another position to set the wobbler at another displacement position.

11. A hydraulic pressure intensifier as defined in claim 10 wherein said selectively operable means is a solenoid controlled valve.

12. A hydraulic pressure intensifier for use in a hydraulic circuit having supply pressure and return fluid lines associated with a user device comprising, a motor-pump unit having a supply pressure port and a return pressure port with the latter port connected to said return fluid line, a branch supply pressure line extending to said supply pressure port, a check valve in said supply pressure line blocking return flow from said user device, said motor-pump unit also having an intensified pressure port, an intensified pressure line connecting said intensified pressure port with said supply pressure line between the user device and said check valve, means for controlling fluid flow to said motor-pump unit, said motor-pump unit having a rotatable cylinder block with a series of cylinders each having a piston movable in succession past said supply pressure port, said return pressure port and said intensified pressure port, and an adjustable wobbler for controlling the stroke of the pistons and therefore the fluid displacement of the cylinders, and means for adjusting the wobbler to vary said displacement and therefore the speed of rotation of the motor-pump unit for the same rate of fluid flow through the motor-pump unit.

13. A hydraulic pressure intensifier as defined in claim 12 including an additional check valve in said intensified pressure line preventing flow from said supply pressure line to said intensified pressure port.

14. A hydraulic pressure intensifier as defined in claim 12 wherein said means for adjusting said wobbler includes means urging said wobbler to one limit position to set the wobbler at one displacement position, and selectively operable means for moving the wobbler to another position to set the wobbler at another displacement position.

15. A hydraulic pressure intensifier as defined in claim 14 wherein said means for adjusting said wobbler includes means responsive to the speed of rotation of said cylinder block.

16. A hydraulic pressure intensifier for use in a hydraulic circuit comprising, a motor-pump unit having a supply pressure port, a return pressure port, and an intensified pressure port, a main stage valve operable to control fluid flow to said motor-pump unit, and said motor-pump unit having a rotatable cylinder block with a series of cylinders each having a piston movable in succession past said supply pressure port, said return pressure port and said intensified pressure port, and an adjustable wobbler for controlling the stroke of the pistons and therefore the fluid displacement of the cylinders, and means for adjusting the wobbler to vary said displacement and therefore the speed of rotation of the motor-pump unit for the same rate of fluid flow through the motor-pump unit to have the motor-pump unit operate within a predetermined speed range with varying rates of fluid flow.

17. A hydraulic pressure intensifier as defined in claim 16 wherein said means for adjusting said wobbler includes a wobbler control piston operatively connected to said wobbler, means urging said wobbler control piston to one limit position to set the wobbler at one displacement position, and selectively operable means for moving the wobbler control piston to another position to set the wobbler at another displacement position.

18. A hydraulic pressure intensifier as defined in claim 17 wherein said selectively operable means is a solenoid controlled valve.

19. A hydraulic pressure intensifier as defined in claim 17 wherein said means for adjusting said wobbler includes means responsive to the speed of rotation of said cylinder block.

20. A hydraulic pressure intensifier as defined in claim 19 wherein said means for adjusting the wobbler includes a differential area control piston operatively connected to said wobbler, and said speed-responsive means includes a speed-responsive governor-controlled valve for controlling a pressure applied to one area of the differential area control piston.

21. A hydraulic pressure intensifier comprising, a rotatable cylinder block having a plurality of cylinders, a piston movably mounted in each cylinder, a port plate positioned adjacent said cylinder block and having three arcuate spaced-apart ports including a supply pressure port, an intensified pressure port and a return pressure port, a wobbler coacting with said pistons to control the length of stroke thereof, whereby a supply of fluid under pressure to said supply pressure port causes said cylinder block to function as a motor with flow of part of the fluid to the return pressure port and part of the fluid being pumped from the cylinders to the intensified pressure port, and means for adjusting the wobbler to vary the stroke of the pistons and thereby vary the speed of the cylinder block comprising a flyweight governor controlled valve structure.

22. A hydraulic pressure intensifier comprising, a rotatable cylinder block having a plurality of cylinders, a piston movably mounted in each cylinder, a port plate positioned adjacent said cylinder block and having three arcuate spaced-apart ports including a supply pressure port, an intensified pressure port and a return pressure port, a wobbler coacting with said pistons to control the length of stroke thereof, whereby a supply of fluid under pressure to said supply pressure port causes said cylinder block to function as a motor with flow of part of the fluid to the return pressure port and part of the fluid being pumped from the cylinders to the intensified pressure port, and means for adjusting the wobbler to vary the stroke of the pistons and thereby vary the speed of the cylinder block comprising a solenoid controlled valve.

* * * * *